US007043180B2

(12) United States Patent
Askren et al.

(10) Patent No.: US 7,043,180 B2
(45) Date of Patent: May 9, 2006

(54) GEAR AND SHAFT ARRANGEMENT FOR AN IMAGE FORMING DEVICE

(75) Inventors: Benjamin Alan Askren, Lexington, KY (US); Peter Alden Bayerle, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 151 days.

(21) Appl. No.: 10/810,131

(22) Filed: Mar. 26, 2004

(65) Prior Publication Data

US 2005/0214030 A1 Sep. 29, 2005

(51) Int. Cl.
*G03G 15/08* (2006.01)
*G03G 15/00* (2006.01)

(52) U.S. Cl. ..... 399/265; 399/167

(58) Field of Classification Search ..... 399/299, 399/302, 306

See application file for complete search history.

(56) References Cited

U.S. PATENT DOCUMENTS 4,975,743 A 12/1990 Surti
5,019,861 A 5/1991 Surti
5,132,728 A 7/1992 Suzaki et al.
5,432,590 A 7/1995 Nomura et al.
5,937,241 A 8/1999 Kumar et al.
6,006,058 A 12/1999 Watanabe et al.
6,009,291 A 12/1999 Curry et al.
6,175,706 B1 1/2001 Watanabe et al.
6,226,478 B1 5/2001 Watanabe et al.
6,240,266 B1 5/2001 Watanabe et al.
6,324,363 B1 11/2001 Watanabe et al.
6,336,018 B1 1/2002 Kawai et al.
6,473,580 B1 10/2002 Inomata
6,490,426 B1 12/2002 Zaman
6,501,926 B1 12/2002 Watanabe et al.
6,501,927 B1 12/2002 Watanabe et al.
6,654,580 B1 11/2003 Yamaguchi et al.
6,671,475 B1 12/2003 Katada et al.
6,684,041 B1 1/2004 Yokomori et al.

FOREIGN PATENT DOCUMENTS

JP 2000214646 A * 8/2000

* cited by examiner

*Primary Examiner*—Quana Grainger
(74) *Attorney, Agent, or Firm*—Coats & Bennett, PLLC

(57) ABSTRACT

A gear unit comprising a shaft and a gear each having a first axial section and a second axial section. The first axial section features the gear having external teeth with an internal surface that corresponds to an external surface of the shaft. The second axial section includes features in the shaft and gear that engage together. Methods of using the gear unit including positioned the gear on the shaft, and rotating the gear relative to the shaft to engage the gear with the shaft.

32 Claims, 5 Drawing Sheets

GEAR AND SHAFT ARRANGEMENT FOR AN IMAGE FORMING DEVICE

BACKGROUND

Gear units having a shaft and attached gear are used in countless devices. Because of their high usage, manufacturers look for low cost methods of producing the gear units. However, it is difficult to produce a gear unit at a low cost that has high motion quality. Poor motion quality often causes the shaft to "wobble" on the shaft during rotation.

Many of the existing gear units experience poor motion quality caused by uniformity problems in one or both of the shaft and gear. For gears, the interior opening that receives the shaft is often the cause of the problems. Poorly constructed interior openings cause the shaft to not seat properly on the shaft. This is especially prevalent in embodiments having interior openings that become non-uniform during use.

Another problem occurs in connecting the gear to the shaft. One common manner of attachment is referred to as a press fit. However, when the stresses of the press fit load are applied, the gear deflects unevenly, especially when the interior opening is non-uniform. Another concern is the press fit assembly of the gear upon the shaft. Due to manufacturing variation as well as creep, press fits have been found to be unreliable in high volume manufacturing environments.

Further, the gear unit should be constructed in an economical manner. Gear units should not be outlandishly priced that it is not practical for use within the device. Improvements to the connection between the gear and shaft should add to the performance of the device, but not at a price that will prevent its use.

SUMMARY

The present invention is directed to a gear unit comprising a gear and a shaft. The gear provides a solid axial and rotational attachment to the shaft.

In one embodiment, the gear device comprises the shaft having a first section offset from a second section, with the second section having an engagement member. The gear also has a first section offset from a second section, with exterior teeth positioned on the first section and an engagement member on the second section. The first sections and second sections are aligned together when the gear is operatively engaged with the shaft. Also, the engagement members are both in the second sections, which is offset from the exterior teeth which are in the first section.

In another embodiment, the gear device includes a first section positioned within a first axial plane with an interior member mounted within an inner diameter of an exterior member. The exterior member further includes outwardly-extending teeth in the first section. A second section is positioned within a second axial plane that is offset from the first axial plane. The second section has a first engagement section at a distal end of the interior member that engages a second engagement section of the exterior member.

One method of using the gear unit comprises positioning the gear over the shaft with the first axial section of the gear aligning with the first axial section of the shaft, and the second axial section of the gear aligning with the second axial section of the shaft. The next step is rotating the gear relative to the shaft with an outer diameter of the first axial section of the shaft moving within an inner diameter of the gear. Rotation further causes a pair of extensions on an inner side wall of the second axial section of the gear to mate within a gap at the second axial section of the shaft. Further, teeth positioned on an exterior surface of the first axial section of the gear are engaged with a second gear within the image forming device.

DETAILED DESCRIPTION

Figure 1:
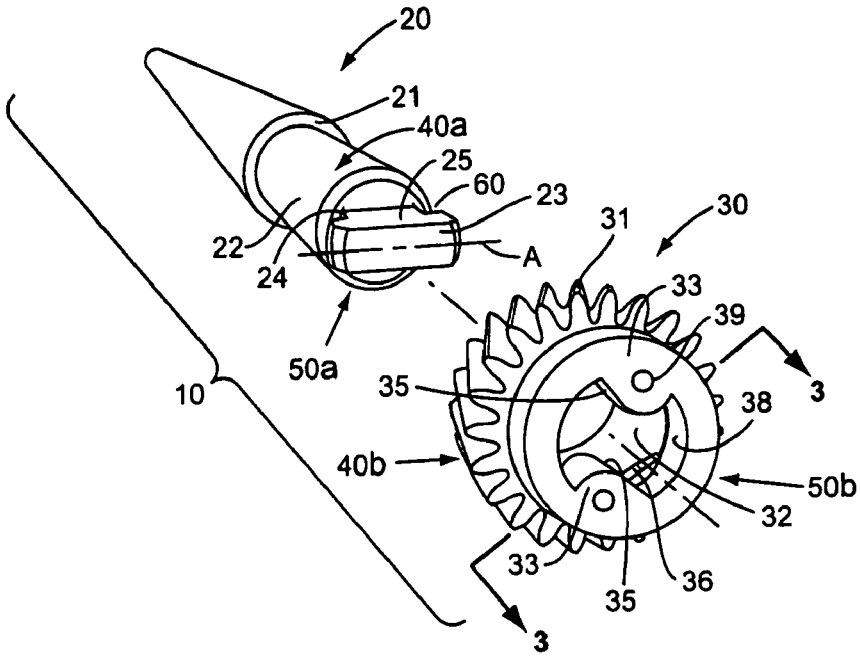
FIG. 1 is an exploded partial perspective view of a gear and shaft according to one embodiment of the present invention.

The present invention is directed to a gear unit, generally illustrated as 10 in FIG. 1, comprising a shaft 20 and a gear 30. The shaft 20 includes a first axial section 40*a*, offset from a second axial section 50*a*. Likewise, the gear includes a first axial section 40*b*, offset from second axial section 50*b*. The first axial sections 40*a*, 40*b* and the second axial sections 50*a*, 50*b* align when the gear 30 is mounted on the shaft 20. The gear 30 includes teeth 31 on the first axial section 40*b*. The second axial sections 50*a*, 50*b* include features that contact together to engage the shaft 20 and gear 30. The teeth 31 are positioned within a first axial plane, and the engagement features are located within a second axial plane.

FIG. 1 illustrates an exploded view of the gear unit 10. The shaft 20 has an elongated shape with the first axial section 40*a* adjacent to, co-axial with, and inward from the distally-positioned second axial section 50*a*. The first axial section 40*a* is substantially cylindrical with a round cross-sectional shape. In one embodiment, the surface of the first axial section 40*a* is smooth.

The second axial section 50*a* is shaped to engage with the gear 30 as will be explained in detail below. In the embodiment of FIG. 1, second axial section 50*a* includes a neck 24 and a head 23. The neck 24 is shorter than the head 23 when measured along the first axis A. The width of the neck 24 may be less than or equal to the head 23 when measured along a second axis that is perpendicular to the first axis A. One or more gaps 60 are formed adjacent to the neck 24 between an inner edge of the head 23 and an outer edge of first axial section 40*a*. One or more contact surfaces 25 extend along the head 23 for contacting the gear 30. In one embodiment, the head 23 is substantially rectangular having two contact surfaces 25 (i.e., as illustrated in FIG. 1, an upper contact surface and a lower contact surface). Other embodiments may also be used, including a D-shaped head having a single contact surface 25.

The gear 30 includes a first axial section 40*b* that is coaxial with a second axial section 50*b*. The first axial section 40*b* includes a plurality of outwardly extending teeth 31. The number, size, shape, and orientation of the teeth 31 may vary depending upon the application. An interior section 32 of the first axial section 40*b* has a shape that conforms to the first axial section 40*a*. In one embodiment, the interior section 32 has a rounded shape with a substantially smooth surface.

The second axial section 50*b* includes a pair of hubs 33 that extend outward from a sidewall 38. Each of the hubs 33 includes a contact surface 35 that contact surfaces 25 of the shaft 20. The hubs 33 and contact surface 35 may have a variety of shapes. The hubs are spaced to be about 180° apart. A distance between the outer edges of the hubs 33 is less than the length of the head 23.

An extension 36 extends outward from the sidewall 38. In one embodiment, extensions 36 are aligned at about a 90° angle to the sidewall 38. Extension 36 has a width less than or equal to the width of the gap 60. In one embodiment, extension 36 has a ramped shape with an increasing size that is at a maximum at the hub 33. In one embodiment, two extensions 36 are positioned on the interior surface 38 and each lead into one of the hubs 33. One or more apertures 39 may be positioned on the hub 33 to prevent shrinkage when the gear 30 is created during a molding process.

Figure 2:
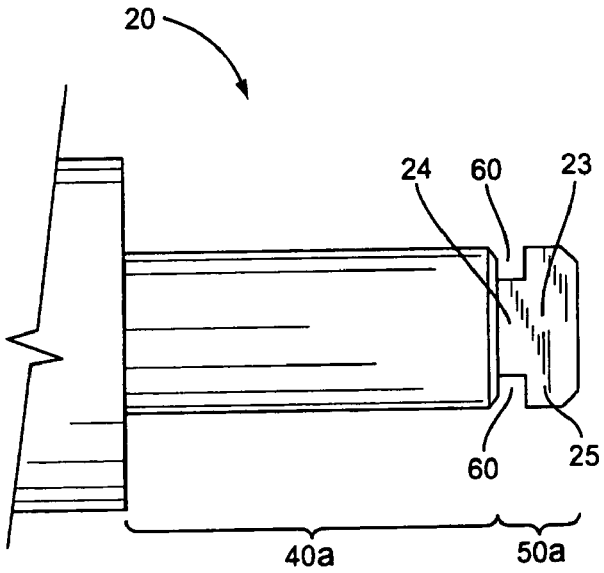
FIG. 2 is a partial perspective view of the gear in a disengaged orientation on the shaft according to one embodiment of the present invention.
Figure 3:
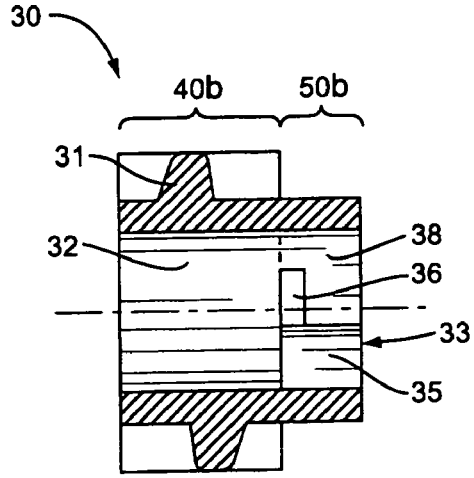
FIG. 3 is a partial perspective view of the gear in an engaged orientation on the shaft according to one embodiment of the present invention.

FIG. 2 illustrates a partial side view of the shaft 20. Gaps 60 are positioned adjacent to the neck 24 on an inner edge of the head 23. FIG. 3 illustrates a cross-sectional view of the gear 30. The extension 36 has a ramped shape that extends into the hub 33. In this embodiment, teeth 31 have a curved configuration with the cut sections on the upper and lower edges being offset when illustrated in cross-section.

Figure 4:
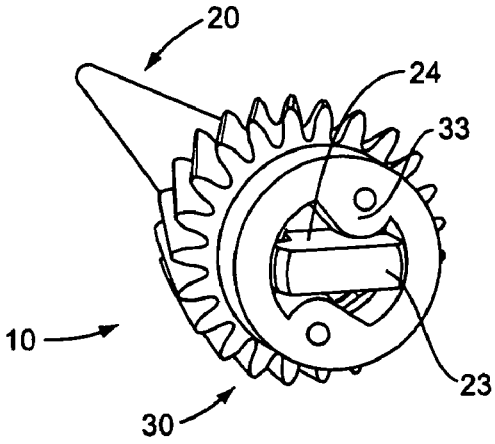
FIG. 4 is a cross-sectional view cut along line 4—4 of FIG. 3 of the gear and shaft in the engaged orientation according to one embodiment of the present invention.

FIG. 4 illustrates the gear 30 positioned on the shaft 20 in a disengaged orientation. The gear 30 is positioned onto the shaft 20 with both the first axial sections 40*a*, 40*b*, and the second axial sections 50*a*, 50*b* being aligned. In this disengaged orientation, the head 23 and neck 24 are aligned adjacent to the hubs 33. The one or more extensions 36 are spaced apart from the one or more gaps 60 and the gear 30 may be removed axially from the shaft 20.

Figure 5:
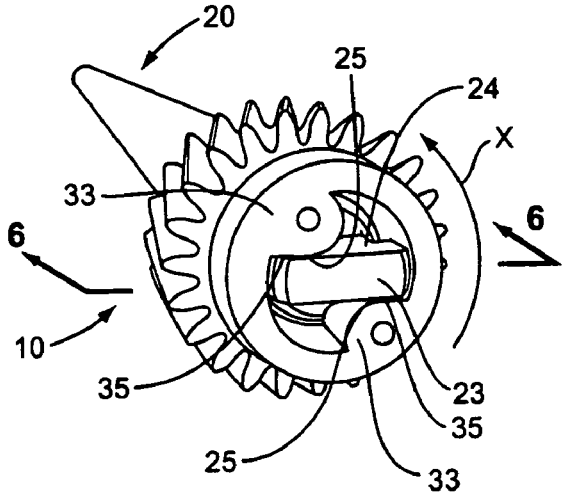
FIG. 5 is schematic view of an image forming device according to one embodiment of the present invention.

FIG. 5 illustrates the gear 30 and shaft 20 in an engaged orientation. The gear 30 has been rotated relative to the shaft 20 in the working direction indicated by arrow X with the one or more extensions 36 now positioned within the one or more gaps 60. The contact surfaces 35 on the hubs 33 are in contact with the contact surfaces 25 of the shaft 20. In the engaged orientation, the gear 30 cannot be axially removed from the shaft 20 because the one or more extensions 36 are held within the one or more gaps 60.

Figure 6:
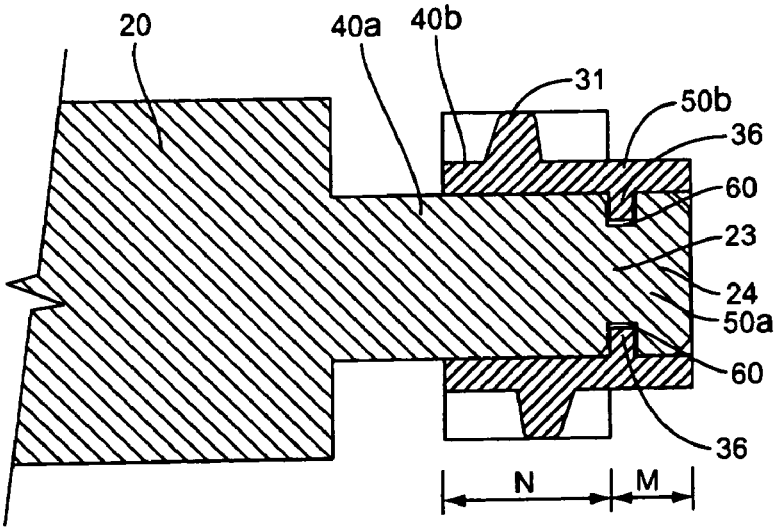
FIG. 6 is partial perspective view of drive mechanisms within the main body of the image forming device according to one embodiment of the present invention.

FIG. 6 illustrates a cross-sectional view of the gear unit 10 in the engaged orientation. The shaft first axial sections 40*a* is longer than the gear first axial section 40*b*. The inner edge of the hub 33 contacts the distal edge of the first axial section 40*a* to control the position of the gear 30 on the shaft 20. In one embodiment, an inner edge of the extension 35 is aligned with the inner edge of the hub 33 and also contacts the distal edge of the first axial section 40*a* when the gear 30 is mounted on the shaft 20. The second axial section 50*a* is engaged with the second axial section 50*b* by the extensions 36 that fit within the gaps 60. The extensions 36 contact the head 25 and prevent the gear 30 from being axially removed from the shaft 20. The width of the gear first axial section 40*b* is illustrated as N, and the width of the gear second axial sections 50*b* is illustrated as M. In one embodiment, the width N is about twice that of width M.

The inside diameter of the first axial section 40*a* of the shaft 20 is sized to fit within the first axial section 40*b* of the gear 30. The relative sizes provide for the gear 30 to rotate about the shaft 20 when moving from the disengaged to the engaged orientation. In one embodiment, the outer diameter of the shaft first axial section 40*a* is slightly larger than the inner diameter of the gear first axial section 40*b*. Gear 30 plastically deforms when the gear is mounted to the shaft 20 for a locational interference fit to physically retain the gear 30 on the shaft 20. The amount of plastic deformation is minimum with no print defects being caused by inaccurate gear movement. In one embodiment, the smallest outside diameter of the first axial section 40*a* and the largest inside diameter of the first axial section 40*b* of the gear 30 fit line-to-line. This arrangement prevents the gear 30 from wobbling relative to the shaft 20, while also reducing the stresses on the gear 30 when the largest outside diameter of the first axial section 40*a* and the smallest inner diameter of the first axial section 40*b* are fitted.

As illustrated in FIG. 6, a first axial plane includes the first axial sections 40*a*, 40*b*. The axial section 40*b* may support and contact the axial section 40*a*, but there is no other engagement between the shaft 20 and gear 30. The teeth 31 are positioned within this first axial plane. A second axial plane includes the second axial sections 50*a*, 50*b*. The gear 30 engages the shaft 20 in this second plane. Distortions in the gear 30 that may result from the engagement with the shaft 20 are minimized in the first axial plane and teeth 31. The minimization of distortions reduces or eliminates transmission errors between the gear 30 and outside member. Further, the engagement allows for high axial loads between the shaft 20 and gear 30.

Figure 7:
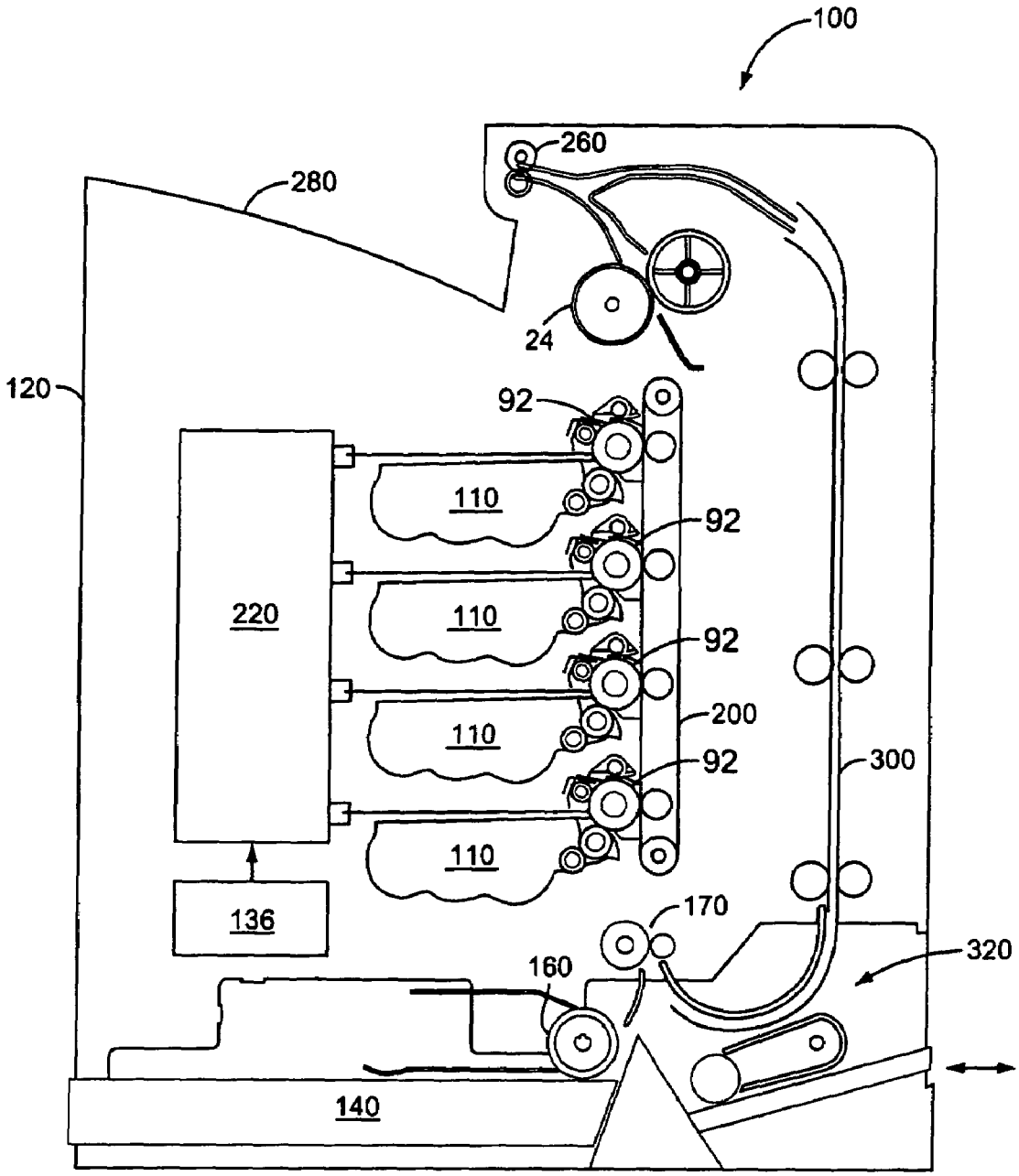
FIG. 7 is a perspective view of an image forming unit according to one embodiment of the present invention.

FIG. 7 illustrates one embodiment of an image forming 100 device in which the gear unit 10 may be used. The image forming device 100 comprises a main body 120 having a media tray 140 with a pick mechanism 160, or a manual input 320, for introducing media sheets into the device 100. The media tray 140 is preferably removable for refilling, and located on a lower section of the device 100.

Media sheets are moved from the input and fed into a primary media path. One or more registration rollers 170 disposed along the media path aligns the print media and precisely controls its further movement along the media path. A media transport belt 200 forms a section of the media path for moving the media sheets past a plurality of image forming units 110. Color printers typically include four image forming units 110 for printing with cyan, magenta, yellow, and black toner to produce a four-color image on the media sheet.

An imaging device 220 forms an electrical charge on a photoconductive member 92 within the image forming units 110 as part of the image formation process. Toner within the image forming units 110 is transferred from a developer member 45 to the charged areas of the photoconductive member 92. The toner is then transferred to the media sheets as they move along the media transport belt 200. The media sheet with loose toner is then moved through a fuser 240 that adheres the toner to the media sheet. Exit rollers 260 rotate in a forward direction to move the media sheet to an output tray 280, or rollers 260 rotate in a reverse direction to move the media sheet to a duplex path 300. The duplex path 300 directs the inverted media sheet back through the image formation process for forming an image on a second side of the media sheet.

The image forming units 110 are removably mounted within the main body 120. The units 110 may include consumable elements, such as toner, developer members 45, photoconductive members 92, and the like, that have a limited lifetime relative to the components within the main body 120. When the consumable elements have been exhausted from one of the individual units 110, the unit 110 is removed from the main body 120 and replaced with a new unit. A one-piece image forming unit is available in Model No. C750 available from Lexmark International, Inc. of Lexington Ky. A two-piece image forming unit is disclosed in U.S. patent application Ser. No. 10/804,488 entitled "Image Forming Device Having a Door Assembly and Method of Use" and incorporated by reference in its entirety.

Figure 8:
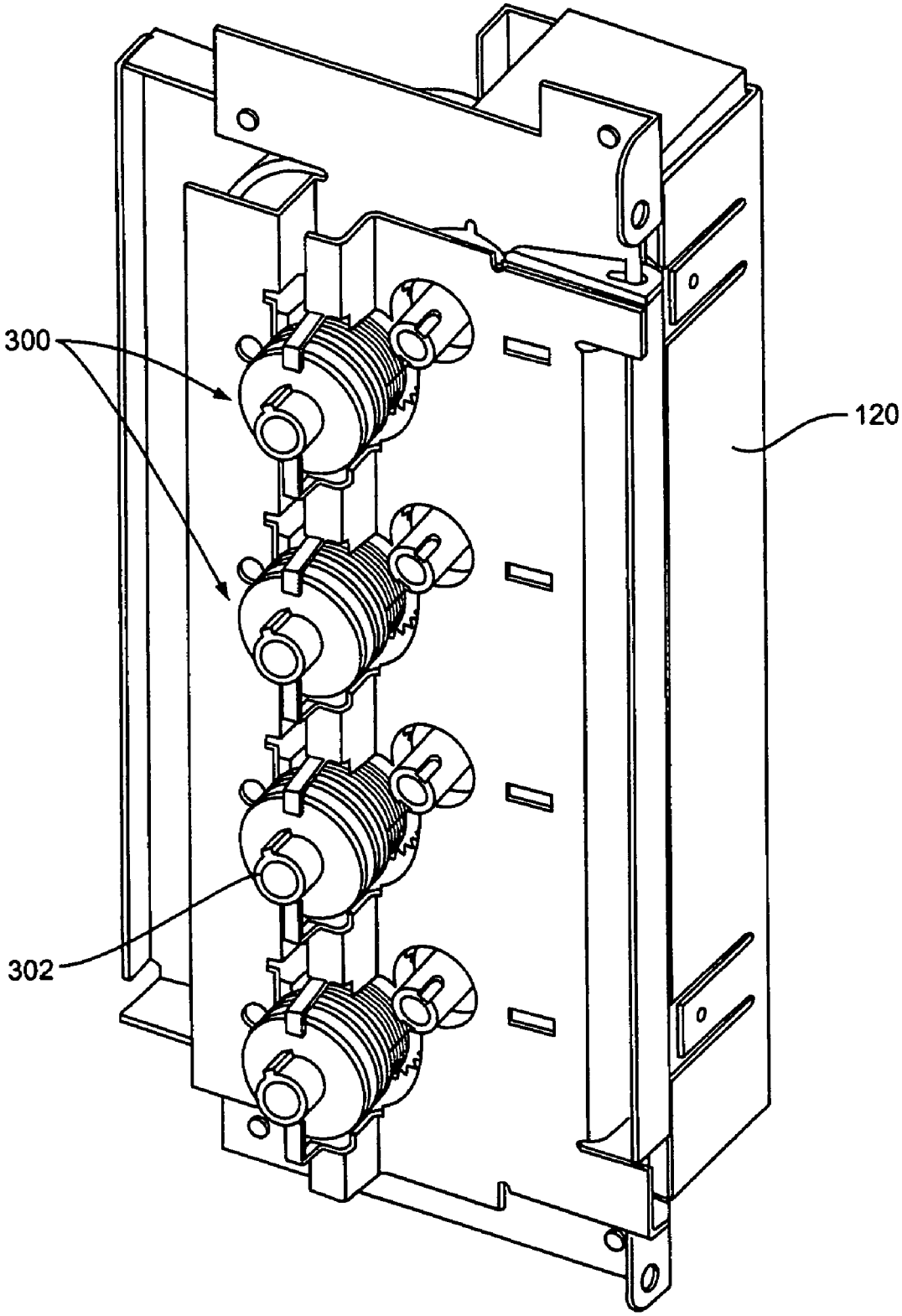
FIG. 8 is a perspective view of drive mechanisms extending from the main body according to one embodiment of the present invention.

The image formation process requires precise timing between the developer member 45, photoconductive member 92, and media sheet moving along the transport belt 200. A controller 136 within the main body 120 oversees the image formation process and ensures the proper timing for acceptable image formation. The rotation of the developer member 45 and the photoconductive member 92 within the image forming units 110 is controlled by drive mechanisms 300 within the main body 120. FIG. 8 illustrates the drive mechanisms 300 extending outward from the main body 120 that mates with the image forming units 110. FIG. 8 illustrates four separate drive mechanisms 300 that each engages one of the image forming units 110. The exact timing of the image formation process is controlled by accurate rotation of the drive mechanisms 300 which in turn are forwarded to the image forming units 110.

Figure 9:
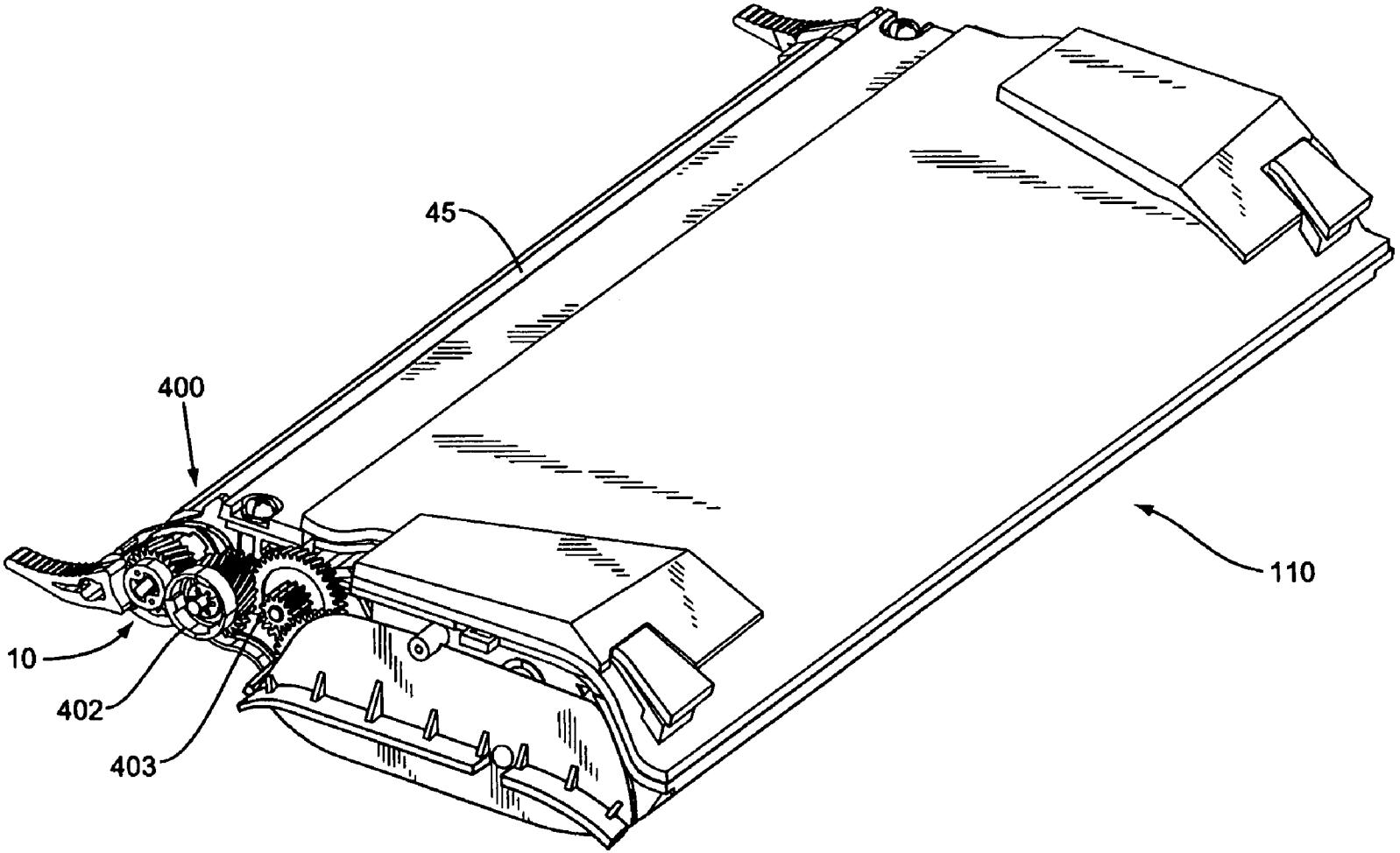
FIG. 9 is a perspective view of an image forming unit according to one embodiment of the present invention.

FIG. 9 illustrates the exterior of an image forming unit 110. The unit 110 includes a gear train 400 including the gear unit 10 which is mounted on the distal end of the developer member 45. When the unit 110 is mounted within the main body 120, the gear train 400 is operatively connected to one of the drive mechanisms 300. Rotation from the drive mechanism 300 is transferred to the gear train 400 and gear unit 10 which in turn causes the developer member 45 to precisely rotate. In the specific embodiment illustrated in FIGS. 8 and 9, drive mechanism 300 includes a connection 302 that mounts within a gear 402. Gear 402 includes exterior teeth that engage the teeth 31 of the gear unit 10. The gear train 400 may also include additional gears 403 for rotating other components, such as the photoconductive member 92, agitating members that move the toner, etc. In the embodiment illustrated, shaft 20 of the gear unit 10 is operatively connected to the developer member 45. The gear unit 10 may also be attached to other components within the image forming units 110, or within the main body 120.

The term "image forming device" and the like is used generally herein as a device that produces images on a media sheet. Examples include but are not limited to a laser printer, ink-jet printer, fax machine, copier, and a multi-functional machine. One example of an image forming device is Model No. C750 available from Lexmark International, Inc. of Lexington Ky.

The present invention may be carried out in other specific ways than those herein set forth without departing from the scope and essential characteristics of the invention. In one embodiment, the gear 30 is constructed of plastic, and the shaft 20 is constructed of metal. In one embodiment, the media path comprises nip rollers that move the media sheets past each of the image forming units 110. In one embodiment, the shaft first axial section 40*a* is at least twice as long as the shaft second axial section 50*a*, and the gear first axial section 40*b* is at least twice as long as the gear second axial section 50*b*. The present embodiments are, therefore, to be considered in all respects as illustrative and not restrictive, and all changes coming within the meaning and equivalency range of the appended claims are intended to be embraced therein.

What is claimed is:

1. A gear device for use within an image forming apparatus comprising:

a shaft having a shaft first axial section offset from a shaft second axial section, the shaft second axial section having a head; and a gear having a gear first axial section offset from a gear second axial section, the gear first axial section having teeth on an exterior surface and an engagement member on the gear second axial section;

the gear being operatively engaged with the shaft with the shaft first axial section positioned within the gear first axial section and the shaft second axial section mounted within the gear second axial section and the engagement member positioned behind the head.

2. The device of claim 1, wherein the shaft first axial section is at least twice as long as the shaft second axial section, and the gear first axial section is at least twice as long as the gear second axial section.

3. The device of claim 1, wherein the shaft first axial section and an interior surface of the gear first axial section both have a round cross-sectional shape.

4. The device of claim 1, wherein the head is positioned on a distal end of the shaft.

5. The device of claim 4, further comprising a neck positioned between the head and the shaft first axial section.

6. The device of claim 5, wherein the engagement member has a ramped configuration that extends outward from a sidewall of the gear second axial section.

7. The device of claim 1, further comprising a pair of hubs positioned on the gear second axial section, a distance between inner edges of the pair of hubs is less than a width of the head.

8. The device of 1, wherein the gear and shaft are part of an image forming unit.

9. The device of claim 8, wherein the gear and the shaft are positioned within a main body of the image forming apparatus.

10. The device of claim 8, wherein the image forming apparatus is a laser printer.

11. The device of claim 1, wherein an outer diameter of the shaft first axial section is larger than an inner diameter of the gear first axial section.

12. A gear device for use within an image forming apparatus comprising:

a shaft comprising:

i. a shaft first axial section having a round cross-sectional shape;

ii. a shaft second axial section having a neck and a head, the neck having a smaller width than the head to form a gap;

and a gear comprising:

a gear first axial section having a round cross-sectional interior and a plurality of teeth extending outward from an exterior surface;

ii. a gear second axial section with a pair of hubs extending inward a first amount from a sidewall, and an extension extending inward from the sidewall a second amount that is less than or equal to the first amount;

the gear being relatively movable on the shaft between a first orientation with the extension positioned away from the gap, and a second orientation with the extension positioned within the gap.

13. The device of claim 12, wherein the shaft first axial section and the gear first axial section are located within a first axial plane, and the shaft second axial section and the gear second axial section are located within a second axial plane that is offset from the first axial plane.

14. The device of claim 13, wherein the first axial plane is substantially parallel with the second axial plane.

15. The device of claim 12, wherein contact surfaces of the pair of hubs are positioned about 180° apart.

16. The device of claim 15, wherein the head width is greater than a distance between the pair of hubs.

17. The device of 12, wherein the gear and shaft are part of an image forming unit.

18. The device of claim 12, wherein the gear and the shaft are positioned within a main body of the image forming apparatus.

19. The device of claim 12, wherein an outer diameter of the shaft first axial section is larger than an inner diameter of the gear first axial section.

20. A gear device for use within an image forming apparatus comprising:

a first section positioned within a first axial plane and having an interior member mounted within an inner diameter of an exterior member, the exterior member having outwardly-extending teeth; and a second section positioned within a second axial plane, the second section having a first engagement section at a distal end of the interior member that engages a second engagement section of the exterior member;

the first axial plane is offset from the second axial plane.

21. The device of claim 20, wherein the interior member is co-axial with the exterior member.

22. The device of claim 20, wherein the first section is at least twice as long as the second section.

23. The device of 20, wherein the gear and shaft are part of an image forming unit.

24. The device of claim 20, wherein the gear and the shaft are positioned within a main body of the image forming apparatus.

25. The device of claim 20, wherein an outer diameter of the interior member is larger than an inner diameter of the exterior member.

26. A image forming unit for use within an image forming apparatus comprising:

a developer member;

a shaft operatively connected to the developer member comprising:

i. a shaft first axial section having a round cross-sectional shape;

ii. a shaft second axial section having a neck and a head with a gap formed therebetween; and a gear operatively connected to the shaft comprising:

i. a gear first axial section having a round cross-sectional interior and a plurality of teeth extending outward from an exterior surface;

ii. a gear second axial section having an open face with a pair of hubs extending inward from a sidewall a first amount, and an extension extending inward from the side wall a second amount that is less than or equal to the first amount;

the gear being relatively movable on the shaft between a first orientation with the extension positioned away from the gap, and a second orientation with the extension positioned within the gap.

27. The device of claim 26, further comprising a housing defining an exterior of the image forming unit, with the gear and a distal end of the shaft being on an outside surface of housing.

28. The device of claim 27, further comprising a toner reservoir positioned within the housing to contain a supply of toner.

29. The device of claim 27, wherein an outer diameter of the shaft first axial section is larger than an inner diameter of the gear first axial section.

30. A method of engaging a gear unit within an image forming apparatus, the method comprising the steps of:

positioning a gear over a shaft with a first axial section of the gear aligning with a first axial section of the shaft, and a second axial section of the gear aligning with a second axial section of the shaft;

rotating the gear relative to the shaft with an outer diameter of the first axial section of the shaft moving within an inner diameter of the gear, and a pair of extensions on an inner side wall of the second axial section of the gear mating within a gap at the second axial section of the shaft; and engaging teeth positioned on an exterior surface of the first axial section of the gear with a second gear within the image forming device.

31. A method of rotating a developer member within a image forming unit comprising the steps of:

positioning a gear over a shaft with a first axial section of the gear aligning with a first axial section of the shaft, and a second axial section of the gear aligning with a second axial section of the shaft;

rotating the gear relative to the shaft with an outer diameter of the first axial section of the shaft moving within an inner diameter of the gear, and a pair of extensions on an inner side wall of the second axial section of the gear mating within a gap at the second axial section of the shaft; and rotating a developer member which is coupled to the shaft.

32. The method of claim 31, further comprising engaging teeth positioned on an exterior surface of the first axial section of the gear with a second gear of the image forming unit.

* * * * *